US009897111B2

(12) United States Patent
Mornan et al.

(10) Patent No.: US 9,897,111 B2
(45) Date of Patent: Feb. 20, 2018

(54) ASPIRATING INDUCTION NOZZLE WITH FLOW TRANSITION

(71) Applicants: Brian J. Mornan, Basking Ridge, NJ (US); Frank J. Beitz, Flemington, NJ (US); Nicholas J. Almerini, North Haledon, NJ (US)

(72) Inventors: Brian J. Mornan, Basking Ridge, NJ (US); Frank J. Beitz, Flemington, NJ (US); Nicholas J. Almerini, North Haledon, NJ (US)

(73) Assignee: Dyna-Tech Sales Corporation, Branchburg, NJ (US)

( * ) Notice: Subject to any disclaimer, the term of this patent is extended or adjusted under 35 U.S.C. 154(b) by 532 days.

(21) Appl. No.: 14/608,726

(22) Filed: Jan. 29, 2015

(65) Prior Publication Data

US 2015/0139823 A1 May 21, 2015

Related U.S. Application Data

(63) Continuation-in-part of application No. 13/067,269, filed on May 20, 2011, now Pat. No. 8,974,272.

(51) Int. Cl.

| | |
|---|---|
| ***F04F 5/46*** | (2006.01) |
| ***F24F 7/02*** | (2006.01) |
| ***F24F 13/26*** | (2006.01) |
| ***F24F 7/00*** | (2006.01) |

(52) U.S. Cl.

CPC ..... *F04F 5/46* (2013.01); *F24F 7/00* (2013.01); *F24F 7/025* (2013.01); *F24F 13/26* (2013.01); *F24F 2007/001* (2013.01)

(58) Field of Classification Search

CPC ..... F24F 7/00; F24F 7/025; F04F 5/46

See application file for complete search history.

(56) References Cited

U.S. PATENT DOCUMENTS

| | | | | | |
|---|---|---|---|---|---|
| 465,590 | A * | 12/1891 | Burke | F04F 5/46 | 417/198 |
| 509,400 | A * | 11/1893 | Ruble | F04F 5/46 | 417/151 |
| 1,556,975 | A * | 10/1925 | Tempest | F24F 7/00 | 454/358 |
| 2,168,681 | A * | 8/1939 | O'Brien | B03C 7/006 | 209/127.2 |

(Continued)

*Primary Examiner* — Alissa Tompkins
*Assistant Examiner* — Phillip E Decker
(74) *Attorney, Agent, or Firm* — Thomas J. Germinario

(57) ABSTRACT

An aspirating induction nozzle is designed to ensure that the discharge velocity is always at or above the governing guidelines while simultaneously leveraging physics to consistently induce fresh air with no moving parts. To achieve this, the flow rate from the fan at the inlet of the nozzle must be accelerated. A frusto-conical transitional flow impinger provides a mechanism to effectively control the flow velocity in the region from the discharge of the fan impeller through the nozzle body. The addition of the impinger provides a mechanism to ensure that flow velocities are always constant or increasing until the discharge plane of the nozzle body, thereby offering a means to optimize the design of the nozzle for the given flow and/or operational pressure drop requirements, while sustaining a tuned venturi effect for steadfast operation in a dynamic environment.

10 Claims, 9 Drawing Sheets

(56) References Cited

U.S. PATENT DOCUMENTS 2,188,564 A * 1/1940 Berg ..... F23L 17/02 454/39
2,626,557 A * 1/1953 Hersch ..... F23L 17/02 454/33
3,719,032 A 3/1973 Cash
3,794,137 A * 2/1974 Teodorescu ..... F01N 1/10 181/256
4,422,524 A * 12/1983 Osborn ..... F02K 1/1207 181/215
4,806,076 A 2/1989 Andrews
5,259,817 A * 11/1993 Schumacher ..... F24F 13/068 454/296
5,403,522 A * 4/1995 Von Berg ..... B01F 3/0876 261/36.1
5,439,349 A 8/1995 Kupferberg
6,112,850 A 9/2000 Secrest et al.
6,431,974 B1 8/2002 Tetley et al.
6,509,081 B1 1/2003 Diamond
6,676,503 B2 1/2004 Hill et al.
7,077,739 B2 * 7/2006 Kupferberg ..... F23L 17/005 454/1
7,241,214 B2 7/2007 Sixsmith
7,547,249 B2 6/2009 Seliger et al.
7,682,231 B2 * 3/2010 Enzenroth ..... B08B 15/002 454/39
8,974,272 B2 * 3/2015 Mornan ..... F24F 13/26 454/39
9,233,386 B2 * 1/2016 Mornan ..... F23L 17/005
9,423,128 B2 * 8/2016 Gans ..... F24F 7/025
2005/0204582 A1 * 9/2005 Rossi ..... B08B 15/002 34/551
2007/0202795 A1 * 8/2007 Seliger ..... B08B 15/002 454/155
2012/0322358 A1 * 12/2012 Wendorski ..... F24F 11/0079 454/340

* cited by examiner

ASPIRATING INDUCTION NOZZLE WITH FLOW TRANSITION

REFERENCE TO RELATED APPLICATIONS

The present application is a continuation-in-part of U.S. non-provisional patent application Ser. No. 13/067,269, filed May 20, 2011, and it also relates to U.S. non-provisional patent application Ser. No. 14/209,154, filed Mar. 13, 2014, the disclosures of both of which are incorporated herein by reference.

BACKGROUND OF THE INVENTION

The present invention relates to the field of exhaust air systems for buildings and/or other enclosed areas, and more particularly, to exhaust discharge nozzles configured to be attached to the outlets of exhaust fans, exhaust ducts and/or stacks, and similar exhaust type equipment/devices and are specifically designed to be installed in the outdoor ambient.

Many commercial and industrial processes exist which introduce hazardous and/or noxious chemicals into the building exhaust. These chemicals originate from a host of commercial/industrial processes within critical environments such as research laboratories, chemical storage facilities, generator housing rooms, thermal oxidizers, exhaust chemical scrubbers, etc. It is of paramount importance that the proper precautions are taken to ensure that the effluent is effectively managed 100% of the time. Specifically designed, purpose built exhaust systems are required to mitigate hazardous concentrations of processes chemicals. As governed by the ASHRAE 2011 HVAC Applications Handbook, a comprehensive flow model of the building must be executed to determine critical fluid flow patterns based on the unique geometry and wind flow patterns for the site. Consideration for the location of near-by air building fresh air intakes is a critical factor which must be accounted for so as to avoid possible effluent re-entrainment into the facility in unprocessed concentrations. In order to be effective, the critical exhaust provisions must be properly designed and must achieve continuous rated performance in the real world dynamic environment where the system is to operate. Failure to meet any of the above criteria would jeopardize the safety of those working in and around the proximity of the critical environment and/or residents of surrounding communities.

An effective solution, as standardized by ASHRAE, is to propel exhaust gases upward to a critical height above the building roofline such that the effluent has exited the building boundary layer (envelope) and entered the atmospheric free stream. The atmospheric free stream essentially provides an effective mechanism to safely exhaust the effluent, by imparting sufficient plume dilution, thus reducing the concentrations of hazardous chemicals to levels deemed safe. If it is impossible or impractical to reach the atmospheric free stream, and thus plume "touchdown" is possible, then sufficient fresh air dilution must be imparted to the effluent prior to the point of discharge to ensure hazardous concentrations are sufficiently dispersed. This critical height above the building roofline is termed the "effective stack height." In its simplest form, the effective stack height is the height at which a theoretical centerline of the building exhaust plume becomes completely horizontal due to the impact of the specified horizontal cross wind velocity. The effective stack height, $h_{se}$ (ft), can be calculated from the American Society of Heating, Refrigerating and Air Conditioning Engineers (ASHRAE) HVAC Applications Handbook as:

$$h_{se}=h_s+h_r-h_d$$

Where:

- h is the physical exhaust system height (ft)
- $h_r$ is the plume rise (ft)
- $h_d$ is the amount of stack wake downwash in (ft)

The plume rise component, $h_r$, is the distance the exhaust plume will be propelled above the terminal discharge point of the physical equipment. Plume rise for momentum driven flow is calculated based on the recommendations of the ASHRAE. From as early as 1999 through 2010 the ASHRAE HVAC Handbook has stipulated the use of a special case of the Brigg's Equations to determine plume rise $h_r$, which is defined as:

$$h_r=3.0\ d_e(V_e/U_H)$$

Where:

- $d_e$ is the effective (hydraulic) diameter (ft) at the terminal discharge point of the system computed from: $d_e=(4A_e/\pi)\hat{}(1/2)$, where $A_e$ is the cross-sectional area of the discharge opening
- $V_e$ is the equipment exit velocity (ft/min) at cross wind velocity
- $U_H$ is the cross wind velocity (ft/min) at the building roofline This adaptation of the Briggs Equation is a function of dynamic variables. Equipment performance data must be acquired using dynamic testing parameters. Specifically, the equipment exit velocity, $V_e$, must be measured with the specified design cross wind, $U_H$, applied to the system. Moreover, it is a necessary condition that the effective diameter, $d_e$, be determined for the location where the equipment exit velocity, $V_e$, was measured. It is recommended that this location be final discharge point (i.e. terminal location) of the exhaust system to the atmosphere. For this form of the Briggs equation for plume rise to be applicable, the discharge velocity profile at the system discharge must be characterized as uniform. A uniform velocity profile is defined as having minimal velocity gradients in the transverse plane of system discharge.

The initial adaptation and application of the Briggs equation for plume rise did not effectively capture many critical site specific parameters, and the accepted method for calculating plume rise has been redefined in Chapter 45 of the ASHRAE 2011 HVAC Applications handbook using the Briggs equation for the vertical jet momentum of the exhaust versus downwind distance as:

$$h_r=\min\{\beta h_x,\beta h_r\}$$

- β is the stack capping factor, 1.0 without cap as in the present invention The plume rise verses downwind distance $h_x$ in (ft) is obtained from:

$$h_x=[(3F_m x)/(\beta_j^2 U_H^2)]\hat{}(1/3)$$

Where:

- $F_m$ is the momentum flux ($ft^4/s^2$) and is calculated as $F_m=V_e^2(d_e^2/4)$
- $\beta_j$ is the jet entrainment coefficient computed as $\beta_j=1/3+(U_H/V_e)$
- x is the downwind distance The final plume rise $h_f$ in (ft) is determined from:

$$h_f=\{0.9[F_m(U_H/U^*)]\hat{}(1/2)\}/(U_H\beta_j)$$

Where:

$U_H/U^*$ is the he logarithmic wind profile computed as $U_H/U^*=2.5\ \ln(H/z_0)$ H is the building height above ground level (ft)

$U^*$ is the friction velocity (ft)

$z_0$ is the surface roughness length (ft) which can be obtained from the Atmospheric Boundary Layer Parameters Table in Chapter 45 of the ASHRAE 2011 HVAC Design Handbook.

The possibility of stack wake downwash, $h_d$, is an essential component to evaluate when computing the effective stack height of an exhaust system. Stack wake downwash occurs where arrogance low velocity exhaust streams are pulled downward by negative pressures immediately downstream of the exhaust system discharge. The amount of stack wake downwash in (ft) can be obtained from $h_d=d_e[3.0-\beta(V_e/U_H)]$ As specified in the ASHRAE 2011 standard, the cross wind velocity at the building roofline $U_H$, as applied to all equations which require this parameter, is the maximum design wind speed at the building roof height at which air intake contamination must be avoided. As stated by ASHRAE, this maximum design speed must be at least as large as the hourly wind speed exceeded 1% of the time. Chapter 14 of the 2009 ASHRAE Fundamentals Handbook lists this value for many cities. When determining this 1% value, the height and terrain of the building in relation to the height of the anemometer and terrain of at the local meteorological station measuring wind speed must be corrected for the effects of boundary layer friction. This is accounted for according to the following expression which appears in Chapter 24 of the 2009 ASHRAE Fundamentals handbook:

$$U_H=U_{met}[(\delta_{met}/H_{met})\hat{}\,a_{met}]*[(H/\delta)\hat{}\,a]$$

Where:

$U_{met}$ is the hourly wind speed as measured from a nearby meteorological station $\delta_{met}$ is the atmospheric boundary layer thickness of the meteorological station which is assigned based on a terrain category which can be obtained from a table of atmospheric boundary layer parameters $H_{met}$ is the height of the anemometer (typically 33 feet)

$a_{met}$ is the meteorological exponent corresponding to the terrain category of the meteorological station which is assigned based on a terrain category which can be obtained from a table of atmospheric boundary layer parameters.

H is the height at which the required windspeed $U_H$ is being adjusted for; typically the discharge location of the exhaust system.

$\delta$ is the atmospheric boundary layer thickness of the exhaust system location which is assigned based on a terrain category which can be obtained from a table of atmospheric boundary layer parameters a is the exponent corresponding to the terrain category of the location where the exhaust system is located which is assigned based on a terrain category which can be obtained from a table of atmospheric boundary layer parameters.

Upon examination of the equation for effective stack height it becomes evident that the most critical parameters affecting a system's ability to achieve this specification are discharge geometry ($d_e$), discharge velocity ($V_e$), and the design wind speed ($U_H$) where the system is to operate. Furthermore, the American National Standards Institute/American Industrial Hygiene Association ANSI/AIHA Z9.5 2012 Laboratory Ventilation standard mandates a minimum discharge velocity of 3000 ft/min be constantly maintained in order to be in compliance. Standard Z9.5 2012 also specifies that the physical exhaust system height, $h_s$, be a minimum of 10 ft. above adjacent roof lines and air intakes and in a vertical up direction.

It should be noted that standard industry testing methods, at the present time do not incorporate cross winds into the testing protocol. The Air Movement and Control Association (AMCA) has developed AMCA Standard 260-07 Laboratory Methods of Testing Induced Flow Fans for Rating and is generally accepted as the industry standard. However, while this test does certify discharge flow volume of an induction exhaust system, it does not include dynamic testing with the influence of a cross wind. Therefore, using outlet flow data to calculate system exit velocities measured according to AMCA standard 260-07 can lead to erroneous discharge velocity ratings. Furthermore, if static system exit velocities (i.e. no cross wind present during measurement) are used in the special case Briggs Equation, which is a function of dynamic variables only, to determine plume rise, the prediction of performance will be physically incorrect. Plume rise (i.e. the quotient) determined in this manner would always be mathematically undefined (i.e infinite asymptote) due to the 0 ft/min cross wind velocity devisor; which is an impossible physical phenomena to achieve. However, if the AMCA standard 260-07 were modified to incorporate cross wind, then the Briggs equations would be a mathematically valid method of calculating plume rise, provided that the velocity profile at the discharge was uniform. Additionally, an advanced engineering approach is to use computational fluid dynamics (CFD) software to calculate system performance; the AMCA 260 test can be simulated with the cross wind component included to develop real world performance data. The Briggs equation is valid for calculating plume rise using the CFD data; however this only applies to systems with a uniform discharge profile. Additionally, the most current methodology of calculating plume rise as defined by ASHRAE should always be used.

The application of discharge nozzles at the exit point of exhaust systems enhances the performance capability by increasing discharge velocity. Increased discharge velocity provides a plume rise component of the exhaust stream with the specific goal of maximizing the exhaust/effluent dispersion and dilution of the hazardous/contaminated air and/or effluent gases and vapors from buildings, rooms, and other enclosed spaces by reaching the atmospheric free stream If it is impossible or impractical to reach the atmospheric free stream, and thus plume "touchdown" is possible, then sufficient fresh air dilution must be imparted to the effluent prior to the point of discharge to ensure hazardous concentrations are sufficiently dispersed. Discharge nozzles may be of the non-inducing or fresh air inducing type. Inducing type discharge nozzles have the unique ability of leveraging physics to draw in fresh ambient air downstream of the primary air mover (fan), while non-inducing type nozzles must draw the fresh air in through a mixing plenum and process the air through the fan, thus requiring a comparatively higher electrical power consumption. Properly designed nozzles are capable of propelling high velocity plumes of exhaust gases to heights sufficient to prevent stack wake downwash and disperse the effluent over a large upper atmospheric area, so as to avoid exhaust contaminant re-entrainment into building ventilation intake zones. Discharge nozzles are able to provide a superior alternative to conventional tall exhaust stacks which do not increase the velocity of the exhaust and thus must be significantly taller than systems discharging at a comparatively higher velocity through the use of discharge nozzles. Tall exhaust stacks are costly to construct, may be prohibited by zoning height restrictions, are visually unattractive by today's architectural standards, and may detract from community relations due to the inherent industrial connotation.

A further development of the exhaust nozzle design is the type nozzle that employs the Venturi effect to draw additional ambient air into the primary effluent stream. The venturi type nozzle can further be described as an aspirating, or induction type, as related to conventional technological description for this type nozzle. The additional induced air volume dilutes the primary exhaust gases at/near the nozzle as the combined mixed air volumes are released into the atmosphere. Also, with this exhaust-air mixture volume increase, the discharged gas is expelled at a higher velocity, achieving a greater plume height. The underlying effect of greater volume at greater discharge velocity is an increased effluent momentum, which assists with the effluent disbursement into the atmosphere.

The features and functions of induction nozzles are described in greater detail in U.S. patent application Ser. No. 13/067,269, the disclosure of which is incorporated herein by reference.

High plume lift is particularly critical with regard to exhaust gases from potentially contaminated sources, such as laboratories and other facilities in which chemical processes produce noxious fumes. To insure that potentially contaminated exhaust reaches a minimum altitude to avoid downwash, many environmental and building code standards specify a minimum discharge velocity from an exhaust nozzle. For example, ANSI Z9.5 2012 currently requires a minimum discharge velocity of 3000 feet per minute (FPM) at the outlet of a lab exhaust nozzle. Therefore, the nozzle must be designed to ensure that the discharge velocity is always at or above the governing guidelines. To achieve this, the flow rate from the fan at the inlet of the nozzle must be accelerated.

In the present invention, a frusto-conical transitional flow impinger provides a mechanism to effectively control the flow velocity in the region from the discharge of the fan impeller through the nozzle body. It is important to note, that any decrease in velocity in the region of the discharge of the fan impeller to the discharge of the nozzle body would require a subsequent re-acceleration of the air stream to initiate and sustain the fresh air inducing venturi effect at the fresh air induction ports within the nozzle. Deceleration and subsequent re-acceleration is very inefficient and increases pressure loss through the nozzle, thereby requiring more fan power, larger fan/motor sizes, and limiting usable range of the device. The addition of the impinger provides a mechanism to ensure that flow velocities are always constant or increasing until the discharge plane of the nozzle body, thereby offering a means to optimize the design of the nozzle for the given flow and/or operational pressure drop requirements.

Fans have a characteristic performance curve for a given impeller rotational speed, whereby the available static pressure is a function of flow rate. As the nozzle can be considered an accessory in the air stream, each characteristic nozzle design has an inherent initial loss at a given flow rate. The pressure drop is the consequence of the additional energy required to accelerate the airstream to the minimum acceptable discharge velocities per ASHRAE/ANSI. As more flow is introduced to the nozzle inlet, the loss (pressure drop) through the nozzle increases according to a square relationship with flow. Thus, one specific nozzle will require all of the available static pressure capacity a specific fan can provide at a given rpm well before the entire unobstructed flow range of the fan is provided. By adjusting the impinger and induction port dimensions, various nozzles that would mount to the same fan, with the same nominal exterior housing dimensions, can be efficiently designed. Thus additional flow can be introduced into the variant nozzle for the same pressure drop and corresponding minimum discharge velocity requirement. The net effect is a re-indexing of the nozzle operating range, such that additional capacity can be provided. This re-indexing strategy can be repeated as many times as necessary to completely cover a given flow range. This flow range can apply to retrofit applications or be leveraged to design nozzle sizes for a specific fan series. Moreover, fans are typically characterized in industry by their nominal impeller diameter which constitutes a given fan series. As the impeller diameter deviates from standard, which may be due to a specific performance goal or application, so will the exterior fan housing dimensions. The present invention has the unique ability to be modified so as to maintain the same engineered velocity and flow profile throughout the nozzle body and plume development chamber, effectively making true application-specific design possible

SUMMARY OF THE INVENTION

The predominant application for the nozzle is mounting to a tubular inline fan. However, the nozzle can be mounted to any devices and/or ductwork through the use of transitions, etc. As depicted in FIGS. 1A and 1B, the typical tubular inline fan, whether belt-driven or direct drive, has an annular discharge area. This annular discharge space generally begins at the immediate discharge of the fan impeller. The outer ring of the annulus is created by the overall fan housing, and the inner ring of the annulus is created by the motor chamber for direct drive or the sheave chamber for belt drive. Guide vanes, which serve to straighten the discharging air stream are often positioned in this annular space. The true outlet velocity of a fan must be measured in this annular region. The preferred design will have a motor enclosure or sheave enclosure which terminates on the same plane as the fan housing.

As shown in FIGS. 2A, 2B and 3, the aspirating nozzle mounts to the discharge flange of the fan which is (preferably) coterminous with the fan housing and motor/sheave enclosure. The frusto-conical transitional flow impinger is designed to mount to the motor/sheave enclosure to continue the annular area of the fan into the nozzle body. The presence of the frusto-conical transitional flow impinger ensures that the exhaust flow area will either stay the same or converge as the flow transitions from the fan to the nozzle; thus velocity is always maintained or increased from the moment it leaves the fan impeller through the nozzle body. It is essential to note that no fresh induction air is permitted to mix with the exhaust flow volume from the fan until the exhaust flow has exited the discharge plane of the "nozzle body" (defined as the plane of the circular top of the frusto-conical transitional flow impinger). Thus, actual exhaust nozzle velocity can be determined and engineered such that the venturi effect can be maximized as the flow exits the discharge plane of the nozzle body and fresh air is induced (aspirated).

As illustrated in FIGS. 2A, 2B and 3, the transitional flow impinger is mounted to the motor/sheave enclosure. The impinger can have a straight tubular extension to extend into the tubular fan housing if the motor/sheave enclosure is not coterminous with the fan discharge. The exhaust flow volume enters a tubular fan, and energy is imparted via the rotating impeller. As the flow volume discharges the impeller passageways, it enters an annular space within the fan. The annular space is defined as the space between the overall fan tubular housing and the tubular internal motor/sheave enclosure of a lesser diameter. The area from the impeller discharge to the location where the motor/sheave enclosure terminates is fan constant, and consequently so is the velocity of the exhaust air stream. Ideally, the annular area created by the fan housing and the motor/sheave enclosure continues to the fan discharge; if not, the impinger can have a tubular extension that completes the annular area.

As the flow discharges the annular fan area, it enters the nozzle inlet. The impinger is engineered such that the area through the nozzle body either remains the same or is decreasing. The "nozzle body" is defined as the area encompassed from the inlet of the nozzle to the top of the frusto-conical transitional flow impinger. Therefore, the nozzle body is the flow passageway through the nozzle where the flow volume is entirely made up of fan exhaust flow. The nozzle body discharge velocity can therefore be optimized to ensure that exhaust velocities of the potentially contaminated airstream are always at or above the guidelines set forth by many governing bodies (ANSI/ASHRAE). It is also important to note that the windband is the actual discharge location of the overall nozzle assembly. And it is the discharge velocity from this location that must be measured to certify overall system compliance.

In the present invention, the frusto-conical transitional flow impinger provides a mechanism to effectively control the flow velocity in the region from discharge of the fan impeller through the nozzle body. It is important to note, that any decrease in velocity in the region of the discharge of the fan impeller to the discharge of the nozzle body would require a subsequent re-acceleration of the air stream to initiate and sustain the fresh air inducing venturi effect at the fresh air induction ports within the nozzle. Deceleration and subsequent re-acceleration is very inefficient and magnifies the pressure drop requirements of the nozzle, thereby requiring more fan power, larger fan/motor sizes, and limiting usable range of the device. The addition of the impinger provides a mechanism to ensure that flow velocities are always constant or increasing until the discharge plane of the nozzle body, thereby offering a means to optimize the design of the nozzle for the given flow and/or operational pressure drop requirements.

As seen in FIG. 3, typically, the triangular induction port outlet vertices are fixed with the top plane of the impinger (approximately ⅛ inch clearance). Therefore, the height of the impinger and its top diameter coupled with the height and base of the triangular outlets, can be varied to significantly optimize the operation of the aspirating nozzle for many inlet flow conditions or desired operational ranges of the device.

The impinger can also be leveraged to control where the vena contracta occurs. As the discharging air volume is accelerated in the nozzle body, the vena contracta is essentially the point in the discharging air stream where the hydraulic diameter is the least and the velocity is at its maximum, characterized by a contraction coefficient, which is defined as the ratio of the area of the exhaust stream (i.e. jet) and the discharge area of the nozzle body (i.e. orifice). The height of the top of the impinger has an intrinsic influence on the vena contracta characteristics. The exhausting air volume will tend to separate from the top of the impinger and converge at a downstream distance which is dependent on impinger height and its top diameter. When the flow converges, the velocity is at a maximum and the vena contracta is evident. The maximized velocity at this point serves to enhance the venturi effect and further improve the induction capacity of the system. This effect is unique to the present invention and serves to optimize plume characteristics and system performance.

The location between the discharge plane of the nozzle body and the windband discharge is known as the "plume development chamber". The plume development chamber is also described as the only space in the overall discharge nozzle where the primary exhaust stream experiences a temporary increase in area. This increased area occurs at a controlled location downstream of the discharge plane of the nozzle body, and serves to accommodate the volume of fresh air being induced by the sustained venturi effect. Once the fresh air is introduced into this space, energy is transferred between the high velocity primary exhaust stream and the fresh air induction flow stream, resulting in a more uniform velocity flow profile of the overall exhaust stream. This "developed" stream is then accelerated to the specified velocity and discharged from the device.

The key principle of the aspirating induction nozzle is that, because of all of the features outlined, the present invention has the unique ability to establish and maintain a venturi effect in the presence of an ambient crosswind. Thus, the system is able to successfully perform over a vastly expanded range of ambient crosswinds with minimal degradation in performance. Prior art in the industry leverages static ambient testing methods with no crosswinds and legacy equations to de-rate performance for real world dynamic condition, which may not physically apply. The frusto-conical transitional flow impinger provides a mechanism to optimize the venturi effect in the presence of a cross wind and thus enables a real world dynamic performance rating to be specified. Discharge velocities and fresh air entrainment are accurately optimized for a given nozzle inlet flow and operating range requirement.

The present invention provides the ability to modify key interior nozzle components to optimize for a specific range of flows while maintaining the same outer physical appearance. It enables application specific design or the ability to design to predefined flow ranges and provide solutions for a given series of fans. The series of fans and/or nozzle is typically defined by the size of the inlet.

Fans have a characteristic performance curve for a given impeller rotational speed whereby the available static pressure is a function of flow rate. As the nozzle can be considered an accessory in the air stream, each characteristic nozzle design has an inherent initial loss at a given flow rate. The pressure drop is the consequence of the additional energy required to accelerate the airstream to the minimum acceptable discharge velocities per ASHRAE/ANSI. As more flow is introduced to the nozzle inlet, the loss (pressure drop) through the nozzle increases according to a square relationship with flow. Thus, one given nozzle will require all of the available static pressure capacity a specific fan can provide at a given rpm, well before the entire unobstructed flow range of the fan is provided. By adjusting the impinger and port dimensions, various nozzles that would mount to the same fan, with the same nominal exterior dimensions, can be efficiently designed. Thus additional flow can be introduced into the variant nozzle for the same pressure drop and corresponding minimum discharge velocity requirement. The net effect is a re-indexing of the nozzle operating range such that additional capacity can be provided. This, re-indexing strategy can be repeated as many times as necessary to completely cover a given flow range. This flow range can apply to retrofit applications or be leveraged to design nozzle sizes for a specific fan series.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

As used in the following claims, the terms "above" and "below" are defined relative to the direction of the primary effluent flow, so that a feature that is "above" another feature is relatively in the downstream direction, and a feature which is "below" another feature is relating in the upstream direction.

DETAILED DESCRIPTION OF THE PREFERRED EMBODIMENTS

Figure 1B:
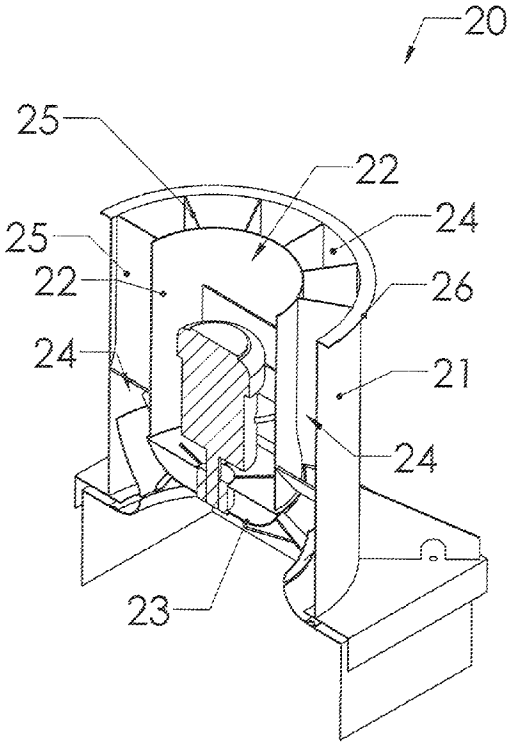
FIG. 1B is an isometric section view of the in-line fan of FIG. 1A taken along the plane A-A.
Figure 1A:
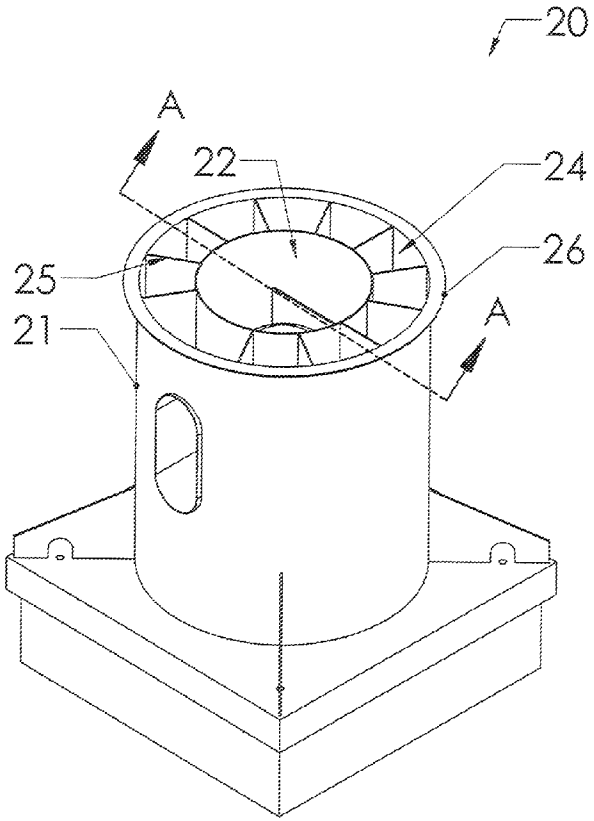
FIG. 1A is an isometric view of a typical in-line fan (direct drive shown, but applies to belt-driven as well)

Referring to FIGS. 1A and 1B, a typical in-line fan assembly 20 comprises a tubular outer fan housing 21, a tubular inner motor/sheave enclosure 22 and an impeller 23. Between the fan housing 21 and the motor/sheave enclosure 22 is formed an annular discharge plenum 24, through which flows a primary exhaust flow from the impeller 23. Multiple radial guide vanes 25 within the discharge plenum 24 serve to straighten the primary effluent flow 16A. The distal end of the fan housing 21 has a discharge flange 26, to which the aspirating induction nozzle assembly 10 of the present invention is mounted.

Figure 2B:
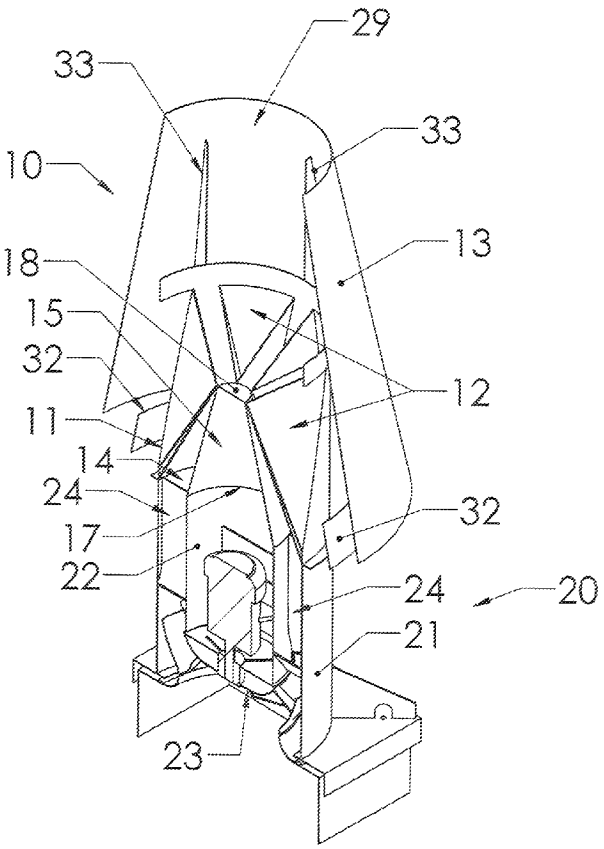
FIG. 2B is an isometric section view of the fan/nozzle assembly of FIG. 2A taken along the plane B-B.
Figure 2A:
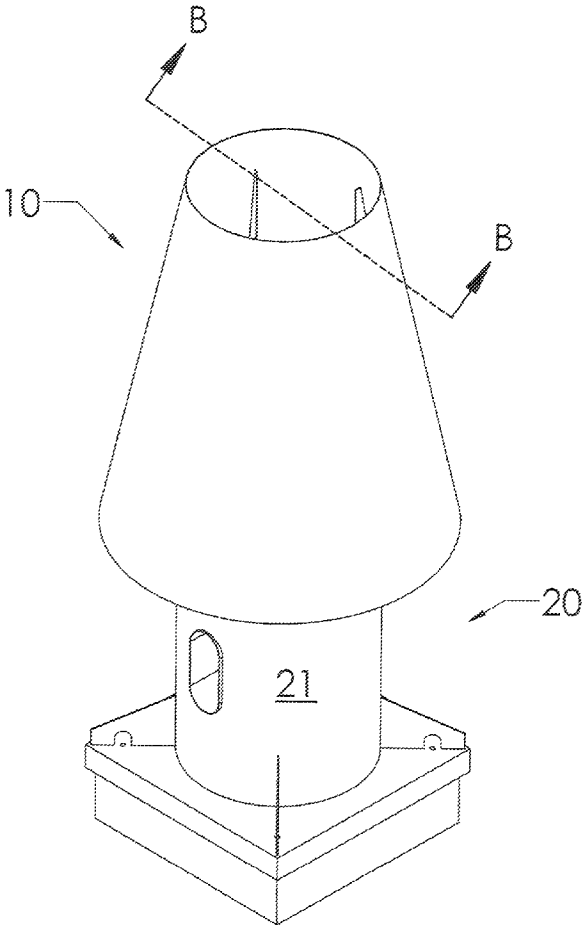
FIG. 2A is an isometric view of a fan/nozzle assembly according to one embodiment of the present invention.
Figure 3:
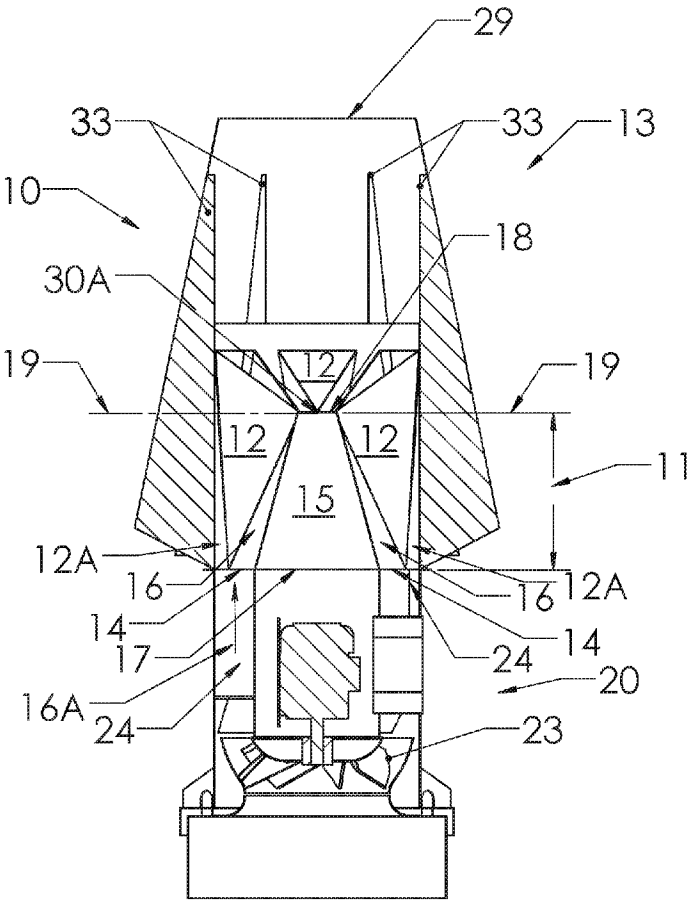
FIG. 3 is a front section view of the fan/nozzle assembly of FIG. 2A taken along the plane B-B.

Referring to FIGS. 2A, 2B and 3, the nozzle assembly 10 comprises a frusto-conical nozzle body 11, multiple tetrahedral induction ports 12, and a frusto-conical windband 13. The nozzle body 11 has a proximal annular inlet 14, which surrounds the base 17 of a frusto-conical transitional flow impinger 15 and communicates with a primary effluent passage 16.

Figure 9B:
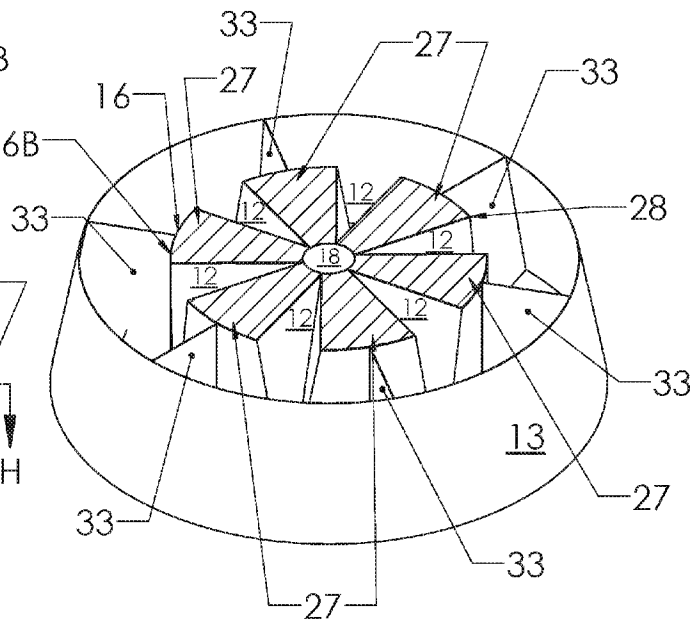
FIG. 9B is a plan section view of the nozzle of FIG. 9A taken along the plane H-H.

Referring to FIGS. 4A through 9B, the induction ports 12 radially converge and slope centripetally from the base 17 to the top 18 of the transitional flow impinger 15, such that the cross-sectional area 16B of the primary effluent passage 16 remains constant or diminishes from the nozzle body inlet 14 to the discharge plane 19 of the nozzle body 11. At the nozzle body discharge plane 19, the cross-section 16B of the primary effluent passage 16 comprises a grid of alternating splayed radial arms 27 between the induction ports 12, as best seen in FIGS. 5B, 7B and 9B. The cross-sectional area 16B of the primary effluent passage 16 at the nozzle body's discharge plane 19, which is the sum of the areas of the radial arms 27, constitutes the nozzle body discharge area 28 (the hatched area of FIGS. 5B, 7B and 9B). The nozzle body discharge area 28 is engineered so that, for a given primary exhaust flow rate (cfm), a minimum flow velocity of 3000 ft/min or greater is achieved at the windband discharge 29.

As best seen in FIGS. 4B, 5A, 6B, 7A, 8B and 9A, each of the port outlets 30 has a port outlet base 12B, which is positioned at a port elevation distance 12C above the nozzle body discharge plane 19. The areas of the triangular outlets 30 of the induction ports 12 can be varied, along with the height of the transitional flow impinger 15 and the diameter of the impinger's top 18, so as to optimize the operation of the aspirating induction nozzle 10 for different inlet flow conditions and/or desired operational ranges.

Figure 4B:
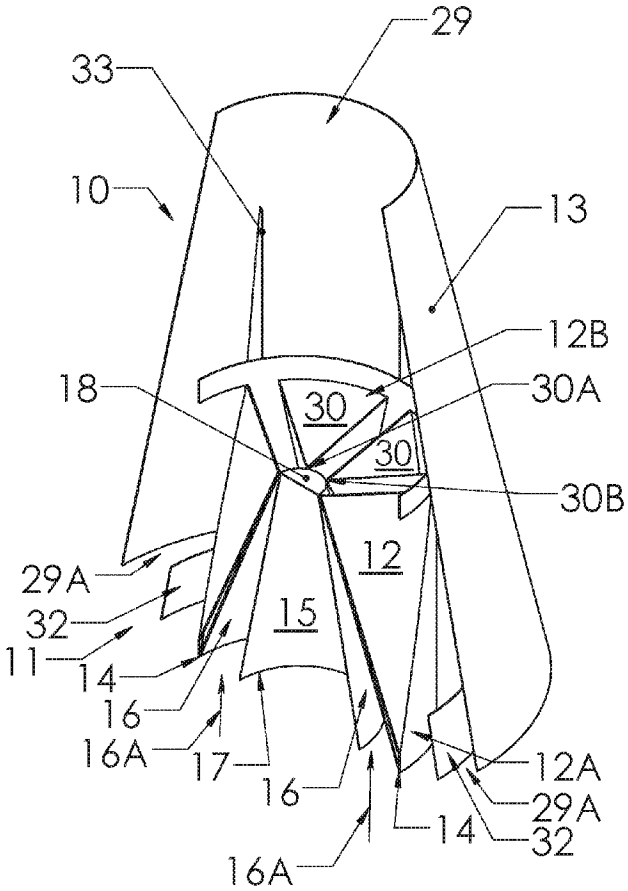
FIG. 4B is an isometric section view of the nozzle of FIG. 4A taken along the plane C-C.
Figure 4A:
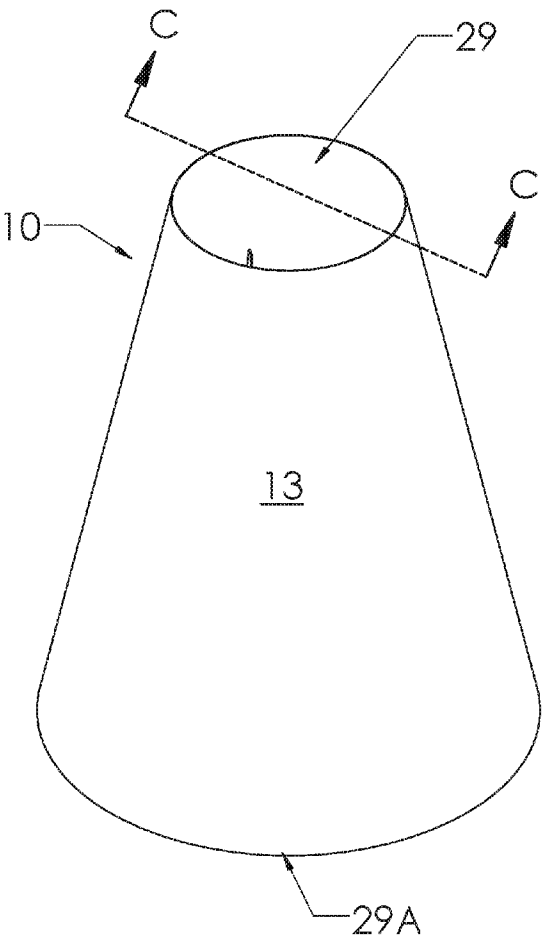
FIG. 4A is an isometric view of a nozzle with a transitional flow impinger engineered for minimum design inlet flow for a given fan series/model size.
Figure 5B:
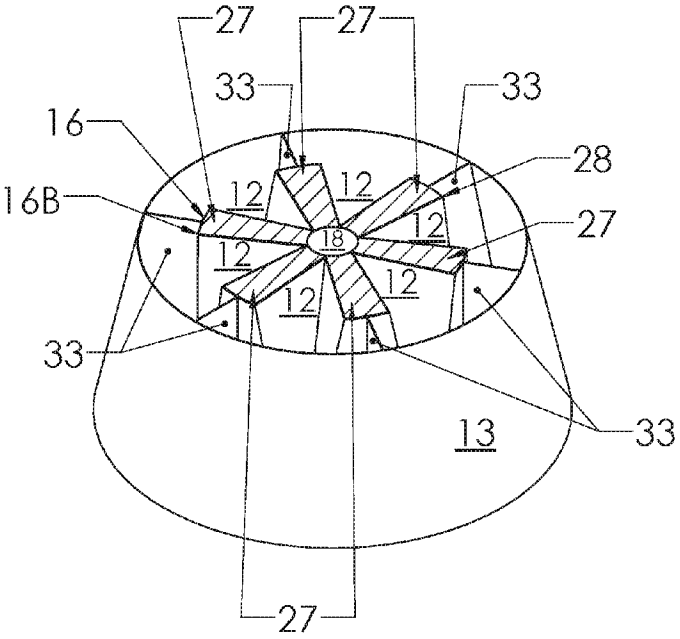
FIG. 5B is a plan section view of the nozzle of FIG. 5A taken along the plane D-D.
Figure 5A:
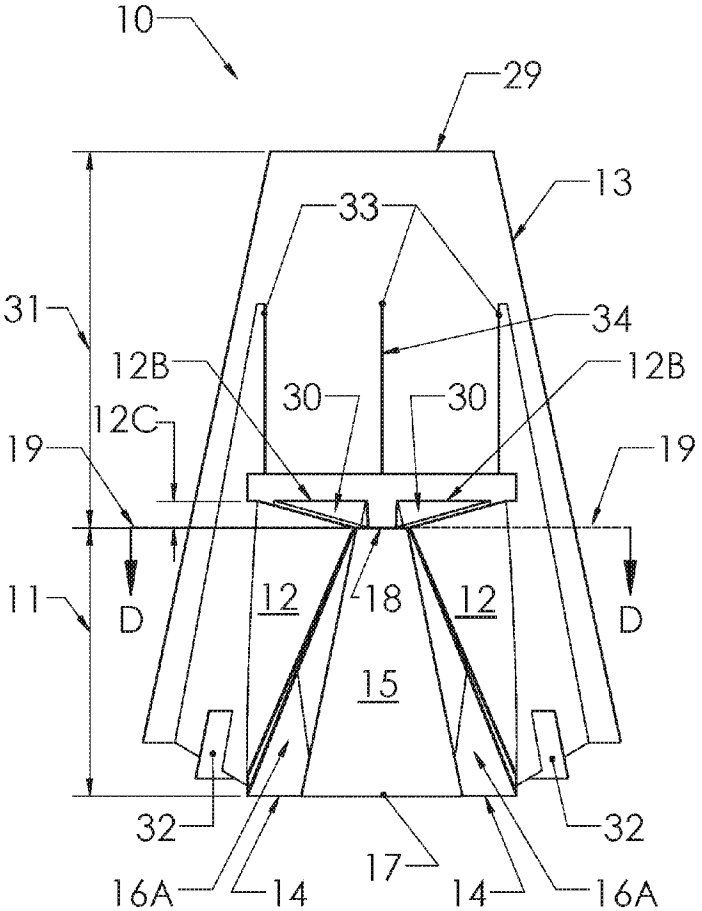
FIG. 5A is a front section view of the nozzle of FIG. 4A taken along the plane C-C.
Figure 6B:
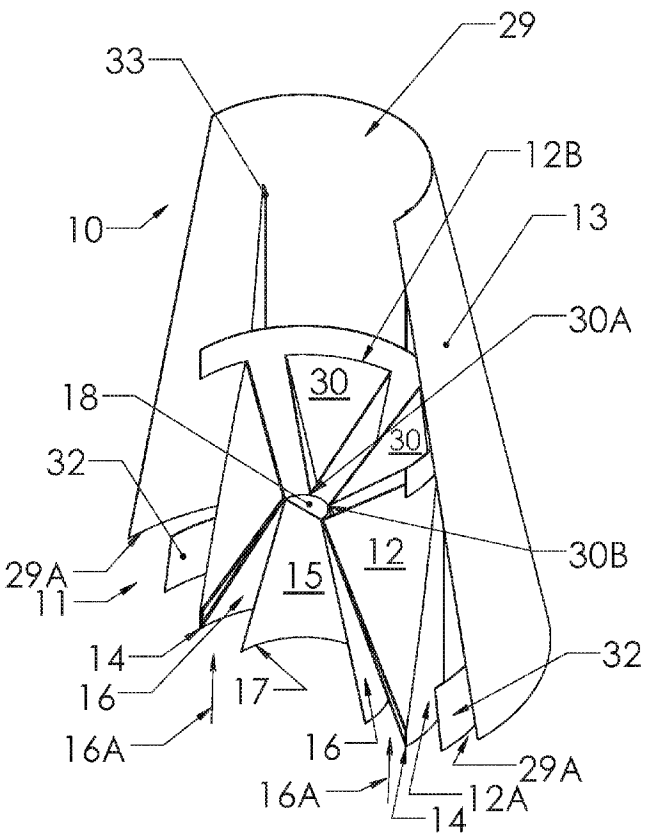
FIG. 6B is an isometric section view of the nozzle of FIG. 6A taken along the plane E-E.
Figure 6A:
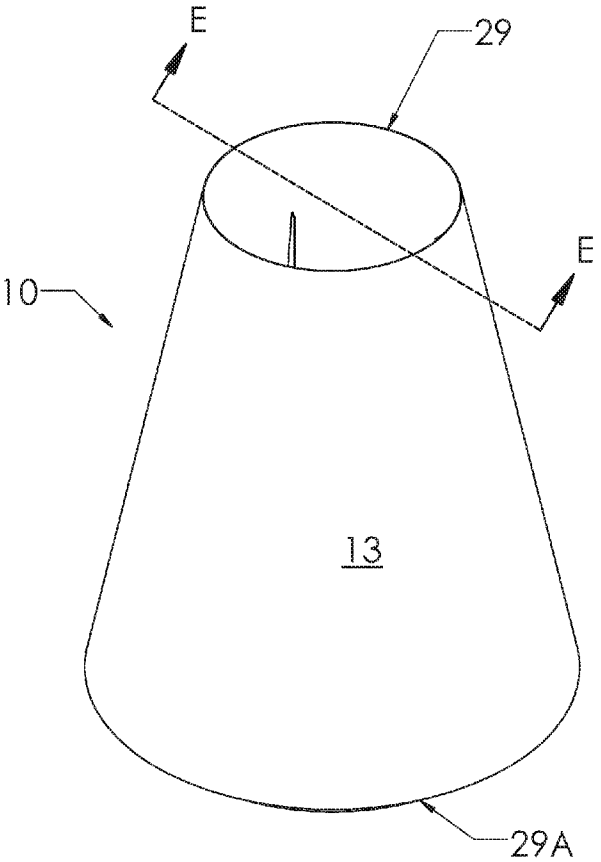
FIG. 6A is an isometric view of a nozzle with an transitional flow impinger engineered for maximum design inlet flow for a given fan series/model size.
Figure 7B:
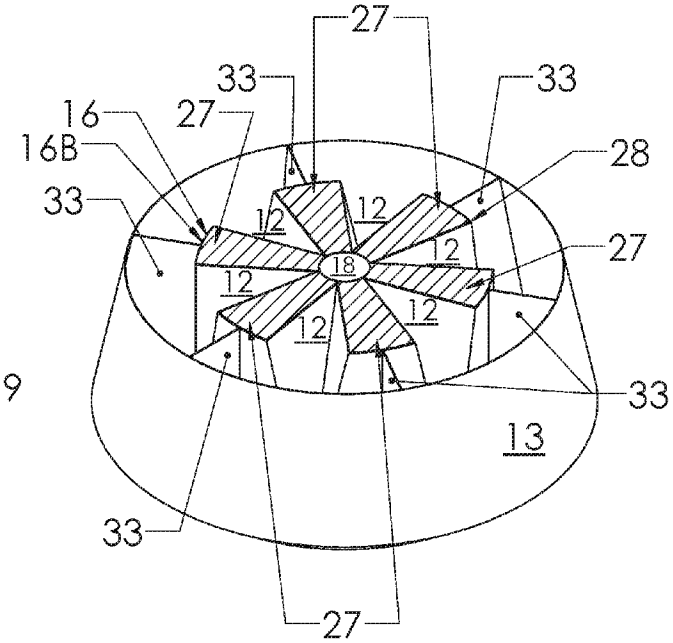
FIG. 7B is a plan section view of the nozzle of FIG. 7A taken along the plane F-F.
Figure 7A:
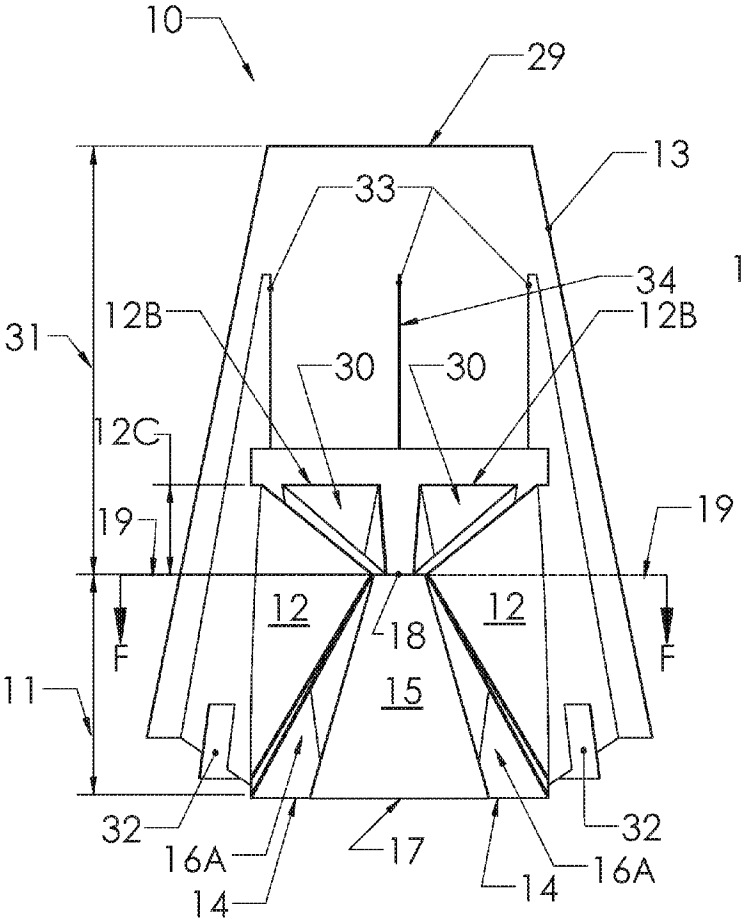
FIG. 7A is a front section view of the nozzle of FIG. 6A taken along the plane E-E.
Figure 8B:
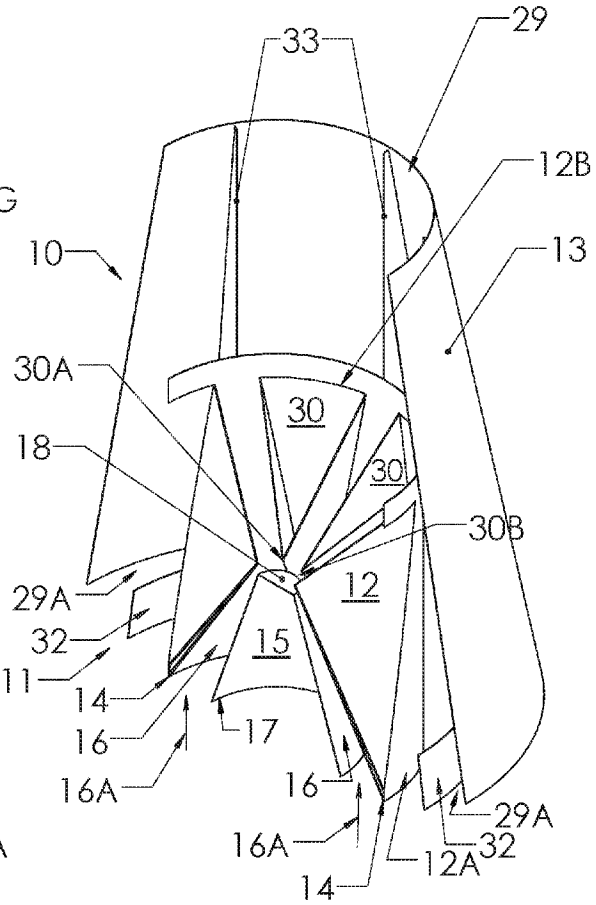
FIG. 8B is an isometric section view of the nozzle of FIG. 8A taken along the plane G-G.
Figure 8A:
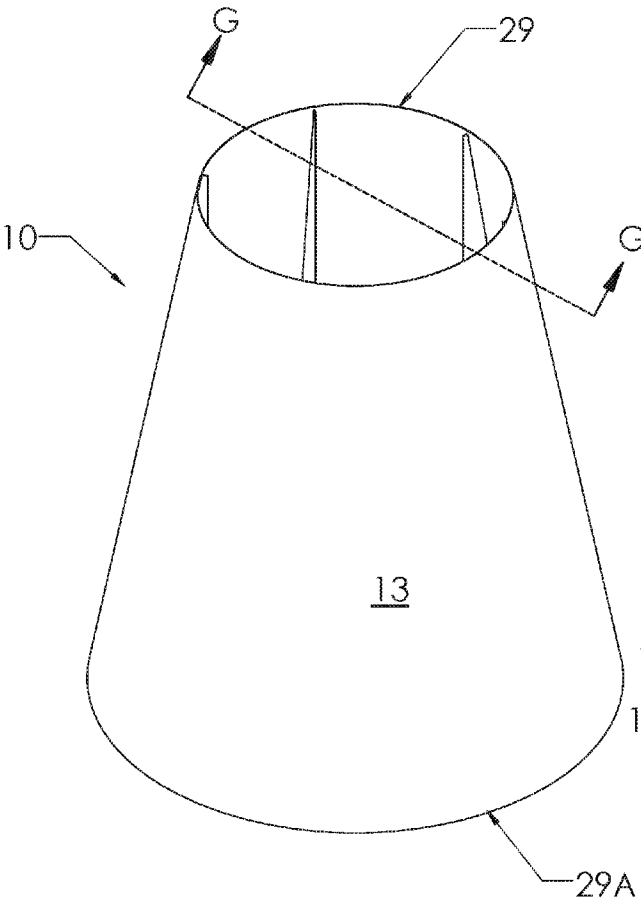
FIG. 8A is an isometric view of a nozzle with induction ports above the top of the transitional flow impinger engineered for reduced exhaust flow volume.

For example, as shown in FIGS. 4B and 5A, for minimum design inlet flow, the impinger 15 is relatively long and the induction port outlets 30 are relatively smaller, as compared to the shorter impinger cone 15 and larger inductor port outlets 30 shown in FIGS. 6B and 7A, which are configured for maximum design inlet flow. As can be seen by comparing FIG. 5B with FIG. 7B, the area of the cross-hatched radial arms 27, which together constitute the nozzle body discharge area 28, is greater for the maximum design inlet flow (FIG. 7B) then for the minimum design inlet flow (FIG. 5B).

Figure 9A:
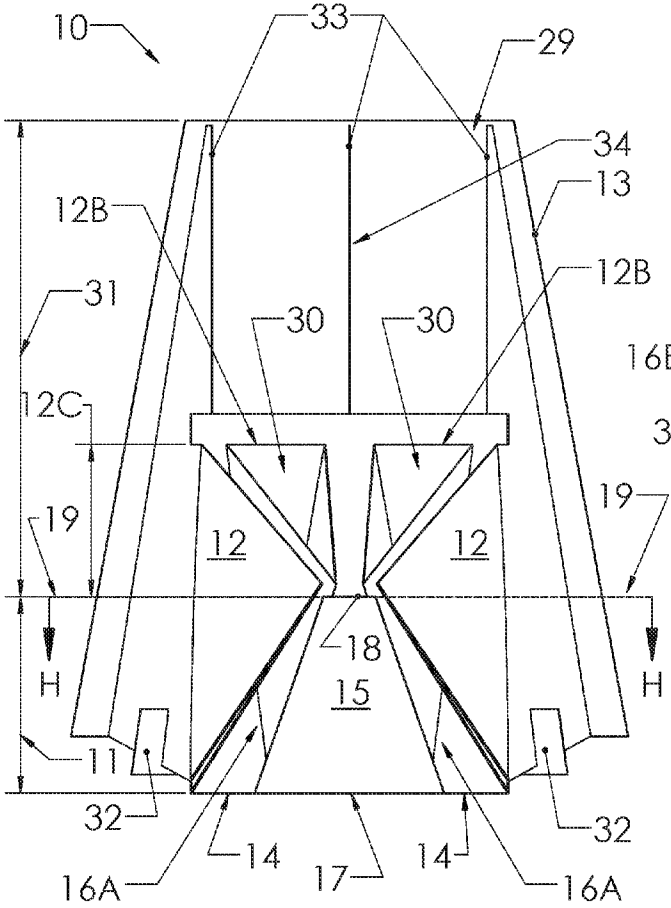
FIG. 9A is a front section view of the nozzle of FIG. 8A, taken along the plane G-G.

As shown in FIGS. 5A, 7A and 9A, the primary effluent flow 16A converges to a vena contracta point 34 above the nozzle body discharge plane 19, at which the primary effluent flow 16A achieves a maximum velocity. As depicted in FIGS. 4B, 5A, 6B and 7A, the vertices 30A of the triangular induction port outlets 30 are typically aligned (within a port clearance offset 30B of approximately ⅛ inch) with the circumference of the impinger top 18. In an alternate design, depicted in FIGS. 8A, 8B, 9A and 9B, the vertices 30A of the port outlets 30 are located at a port clearance offset 30B slightly above the impinger top 18. The annular primary exhaust flow does not converge immediately after the impinger top 18, but continues downstream in a gradually converging annular pattern above the impinger top 18. Therefore, if the port outlet vertices 30A extend into the region above the impinger top 18, which is a "dead" flow space, the nozzle body discharge area 28 can be slightly reduced to accommodate lesser primary effluent flows 16A without reducing the flow velocity at the windband discharge 29.

Referring to FIGS. 4A, 4B, 5A, 6A, 6B, 7A, 8A, 8B and 9A, the full-length windband 13 extends annularly around the central nozzle body 11 from the windband inlet 29A at or below the port inlet opening 12A to shield the induction ports 12 from performance-degrading cross-winds. The windband also creates a protected plume development zone 31 between the nozzle body 11 and the windband discharge 29, where the primary exhaust flow and fresh induction air merge into a single airstream as they are accelerated to the required discharge velocity. The net effect is a near uniform transverse discharge velocity profile, which serves to maximize plume integrity and minimize turbulence.

As shown in FIGS. 4B, 5A, 6B, 7A, 8B and 9A, the inlet baffle 32 serves to straighten the flow of induction air entering the induction ports 12, thus ensuring that the flow is laminar and avoiding noise-generating turbulence. Full length windband brackets 33 are used to fasten the windband 13 to the interior nozzle assembly 10 and to secure the inlet baffle 32. Additionally, the brackets 13 serve as full-length guide vanes with three distinct aerodynamic purposes. First, they segregate each induction port 12, thereby minimizing the impact of crosswind infiltration. Second, they extend below the windband 13 and serve to eliminate potential flow attachment to the tubular nozzle body 11. Third, they extend into the plume development chamber 31 to straighten the discharging exhaust volume.

The nozzle 10 can be designed with an acoustic treatment provision which is integral to the induction ports 12. This feature is integral to the design of the nozzle 10 and provides sound attenuation with no additional system height or equipment. As an example of this feature, perforated stock can be formed around each prevailing surface of the induction ports 12 on the interior of the nozzle 10. The perforated material is then mounted to each induction port 12 so as to form a cavity to be packed with the acoustic fill. Mineral wool, or similar acoustic media, is then packed into the cavity. As the airflow passes the perforated and packed cavities on the port 12, turbulent eddies are reduced and excessive sound waves are absorbed. Thus the sound power level of the device is reduced.

Similar to the acoustic treatment of the induction ports 12, the impinger 15 can be outfitted with a perforated sheet material layer forming a cavity on all sides. This cavity can then be packed with acoustic attenuation media. As an alternative, the impinger 15 itself can be constructed of the perforated material, and filled entirely with acoustic attenuation media. Again, as the airflow passes the perforated and packed pod, turbulent eddies are reduced and excessive sound waves are absorbed. Thus the sound power level of the device is reduced.

Although the preferred embodiments of the present invention have been disclosed for illustrative purposes, those skilled in the art will appreciate that many additions, modifications and substitutions are possible, without departing from the scope and spirit of the present invention.

What is claimed is:

1. An aspirating induction nozzle assembly vertically connected downstream of a fan assembly, comprising:

a frusto-conical central nozzle body, defined by a nozzle body wall, having an interior and an exterior, multiple tetrahedral induction ports, a plume development zone, and a frusto-conical windband, which has an interior and an exterior, and which is attached in converging annular spaced relation to the exterior of the central nozzle body wall by multiple mounting brackets, and which has a proximal windband inlet and a distal windband outlet;

wherein the central nozzle body comprises a proximal annular nozzle body inlet, a distal nozzle body discharge plane, and a frusto-conical impinger, which is axially disposed within the central nozzle body, and which has an exterior impinger surface, a circular impinger base, and a circular impinger top, such that the circular impinger top is encompassed by the nozzle body discharge plane, and such that the circular impinger base and the interior of the nozzle body wall together define the annular nozzle body inlet;

wherein the frusto-conical impinger is upwardly tapering from the circular impinger base to the circular impinger top, and wherein the circular impinger base horizontally aligns with the nozzle body inlet and the circular impinger top horizontally aligns with the nozzle body discharge plane;

wherein the central nozzle body further comprises a converging primary effluent passage, which is defined by the exterior impinger surface and the interior of the nozzle body wall, and through which a primary effluent flow, discharged from the exhaust gas outlet at an inlet exhaust flow rate and an inlet static pressure, flows through the central nozzle body, and wherein the primary effluent passage has a primary effluent cross-section that constricts from the nozzle body inlet to the nozzle body discharge plane, such that the primary effluent flow maintains a constant or increasing primary effluent flow velocity through the central nozzle body, thereby avoiding energy losses due to decelerations of the primary effluent flow, and wherein the primary effluent cross-section at the nozzle body discharge plane contains a nozzle body discharge area comprising a grid pattern of multiple radial arms alternating between the induction ports;

wherein each of the induction ports has a port inlet and a port outlet, and wherein each port outlet has a triangular configuration, comprising a triangle with a distal base, which defines a port outlet base, and a proximal vertex, which defines a port outlet vertex, and wherein each of the port inlets extends obliquely from a port inlet opening, located between the exterior of the nozzle body wall and the interior of the windband, to the port outlet, and wherein each port outlet vertex is aligned, within a port clearance offset, with the nozzle body discharge plane, and wherein each port outlet base is positioned at a port elevation distance above the nozzle body discharge plane;

wherein a constriction of the primary effluent passage in the nozzle body causes the primary effluent flow to accelerate over and around the port outlets, creating negative pressure at the port outlets and thereby drawing a volume of induced ambient air through the port inlets into the plume development zone, in which the grid pattern provides an extended boundary for intermixing of the primary effluent flow with the volume of induced ambient air to produce a nozzle discharge flow, which has a volume greater than a volume of the primary effluent flow, and which is discharged at the windband outlet; and wherein the windband convergingly extends annularly around the central nozzle body from the windband inlet at or below the nozzle body inlet and the port inlet openings to the windband outlet above the port outlets, thereby shielding the induction ports from ambient cross-winds and enclosing the plume development zone between the nozzle body discharge plane and windband outlet, such that a secondary induction process takes place in the plume development zone, whereby the nozzle discharge flow induces a secondary induction flow of ambient air through the windband, so as to produce a windband discharge flow, comprising the nozzle discharge flow merged with the secondary induction flow of ambient air induced through the windband, and having a windband discharge flow velocity; and wherein the frusto-conical impinger and the induction ports are configured so that, for a given inlet exhaust flow rate and inlet static pressure, the windband discharge flow velocity is a design discharge flow velocity, which is equal to or greater than 3000 ft/min.

2. The aspirating induction nozzle assembly of claim 1, wherein multiple mounting brackets extend the full length of an annular space between the exterior of the central nozzle body wall and the interior of the windband to define individual ambient air channels leading to each of the port inlets, and wherein the ambient air channels direct ambient air into the port inlets and block crosswind currents from circulating around the annular space between the exterior of the central nozzle body wall and the interior of the windband.

3. The aspirating induction nozzle assembly of claim 2, wherein each of the port outlets has a port outlet area, and wherein the frusto-conical impinger has an impinger height, an impinger base diameter and an impinger top diameter, and wherein some or all of multiple nozzle design dimensions, comprising the port outlet area, the port elevation distance, the impinger height, the impinger base diameter, and the impinger top diameter, are configured to achieve the design discharge flow velocity for the given inlet exhaust flow rate.

4. The aspirating induction nozzle assembly of claim 3, wherein, for the given inlet exhaust flow rate which is a minimum inlet exhaust flow rate, some or all of the nozzle design dimensions are smaller relative to the nozzle design dimensions for the given inlet exhaust flow rate which is a maximum inlet exhaust flow rate.

5. The aspirating induction nozzle of claim 4, wherein the primary effluent flow converges to a vena contracta point above the nozzle body discharge plane, at which the primary effluent flow achieves a maximum effluent flow velocity, and wherein some or all of the nozzle design dimensions are configured to position the vena contracta point so as to maximize the volume of induced ambient air while maintaining the design discharge flow velocity under dynamic conditions of the inlet exhaust flow rate, the inlet static pressure and a velocity of ambient cross winds.

6. The aspirating induction nozzle of claim 3, wherein the port clearance offset is ⅛ inch or less from a circumference of the circular impinger top.

7. The aspirating induction nozzle of claim 6, wherein the primary effluent flow converges to a vena contracta point above the nozzle body discharge plane, at which the primary effluent flow achieves a maximum effluent flow velocity, and wherein some or all of the nozzle design dimensions are configured to position the vena contracta point so as to maximize the volume of induced ambient air while maintaining the design discharge flow velocity under dynamic conditions of the inlet exhaust flow rate, the inlet static pressure and a velocity of ambient cross winds.

8. The aspirating induction nozzle of claim 3, wherein the port clearance offset is greater than ⅛ inch, thereby reducing the nozzle body discharge area, and thereby accommodating a reduced inlet exhaust flow rate without reducing the windband discharge flow velocity.

9. The aspirating induction nozzle of claim 8, wherein the primary effluent flow converges to a vena contracta point above the nozzle body discharge plane, at which the primary effluent flow achieves a maximum effluent flow velocity, and wherein some or all of the nozzle design dimensions are configured to position the vena contracta point so as to maximize the volume of induced ambient air while maintaining the design discharge flow velocity under dynamic conditions of the inlet exhaust flow rate, the inlet static pressure and a velocity of ambient cross winds.

10. The aspirating induction nozzle of claim 3, wherein the primary effluent flow converges to a vena contracta point above the nozzle body discharge plane, at which the primary effluent flow achieves a maximum effluent flow velocity, and wherein some or all of the nozzle design dimensions are configured to position the vena contracta point so as to maximize the volume of induced ambient air while maintaining the design discharge flow velocity under dynamic conditions of the inlet exhaust flow rate, the inlet static pressure and a velocity of ambient cross winds.

* * * * *